United States Patent [19]

Wyse

[11] 4,050,632

[45] Sept. 27, 1977

[54] LOW NOISE AIR NOZZLE

[75] Inventor: Harold G. Wyse, Dayton, Ohio

[73] Assignee: Gad-Jets, Inc., Dayton, Ohio

[21] Appl. No.: 723,435

[22] Filed: Sept. 15, 1976

[51] Int. Cl.[2] ..... B05B 1/34

[52] U.S. Cl. ..... 239/425; 239/552; 239/590.5; 239/DIG. 22

[58] Field of Search ..... 239/552, 291, 590, 590.3, 239/590.5, 424.5, 425

[56] References Cited

U.S. PATENT DOCUMENTS

| | | | |
|---|---|---|---|
| 3,647,142 | 3/1972 | Drude et al. | 239/DIG. 22 |
| 3,790,085 | 2/1974 | Ayer | 239/291 |
| 3,814,329 | 6/1974 | Clark | 239/DIG. 22 |

*Primary Examiner*—Johnny D. Cherry
*Assistant Examiner*—Michael Mar

[57] ABSTRACT

Secondary and tertiary air passages through the air nozzle surround the primary compressed air passage and induce a flow of low pressure air which surrounds the stream of compressed air to reduce the noise to acceptable levels. When the outlet end of the nozzle is blocked, flow through the tertiary air passages reverses to allow the compressed air to escape therethrough.

6 Claims, 6 Drawing Figures

LOW NOISE AIR NOZZLE

BACKGROUND OF THE INVENTION

This invention relates to air nozzles, and more particularly to a low noise air nozzle for discharging a stream of compressed air. Such nozzles are commonly used in manufacturing plants to clean or blow away oil, water, dust, or other foreign matter clinging to machine parts, etc., as well as for moving or positioning parts for assembly.

Prior art air nozzles have tended to be noisy, and OSHA standards have therefore been set to limit the maximum sound level to 85 decibels. Some prior art nozzles also pose pressure hazards, and OSHA standards therefore limit the maximum pressure at the nozzle to 30 PSIG if the nozzle outlet area becomes blocked. Limiting the pressure prevents a machine operator from inadvertently blowing air into his blood if the nozzle is accidentally pressed against his skin. Ideally, these conditions should be satisfied in the least expensive way possible, but low noise, pressure relieving air nozzles have generally been complicated and expensive.

SUMMARY OF THE INVENTION

Briefly, the present invention provides a generally tubular air nozzle body having a fitting at one end for connection to a supply of compressed air, such as an air hose. Passing longitudinally through the center of the body is a central or primary orifice which discharges a primary stream of compressed air through an opening on the end opposite the hose fitting.

A series of secondary orifices surrounds the primary orifice, extending longitudinally and parallel thereto. The secondary orifice discharge openings, which are adjacent to and surround the central orifice opening, are angled outwardly therefrom. The secondary orifices are also connected to receive compressed air from the hose fitting on the nozzle body, and their discharge openings thus discharge compressed air in an outwardly expanding or diverging annular cone, surrounding the primary stream of compressed air from the central or primary orifice discharge opening.

A shroud surrounds the primary and secondary orifices and defines the tubular exterior of the air nozzle body. The shroud also defines a plurality of tertiary air passages through the nozzle body having outlets adjacent to and surrounding the secondary orifice discharge openings. The shroud also helps define inlets for the tertiary air passages, the inlets being well back along the nozzle body near the air hose fitting. The shroud surrounds the primary, secondary, and tertiary discharge and outlet openings and extends a predetermined distance outwardly therefrom away from the remainder of the nozzle body, defining a shroud outlet on the end most remote from the remainder of the nozzle body.

When compressed air is blown through the nozzle, the high velocity compressed air from the secondary orifices moves at high velocity past the outlets of the tertiary air passages. This creates a venturi effect at the tertiary air passage outlets, and the reduced air pressure from this venturi effect induces a forward flow of air through the tertiary air passages from their inlets to their outlets. This flow of air is low pressure air drawn from the ambient atmosphere. As the low pressure air is discharged it accompanies and surrounds the compressed air from the central and secondary orifice discharge openings. This shroud of low pressure induced air forms a sound deadening curtain around the discharged high pressure air, reducing the noise level to within the limits predescribed by OSHA.

In the event that the discharge or outlet end of the shroud becomes blocked, the tertiary air passages provide a relief or escape route for the compressed air. Thus, if a person places the nozzle against an object, such as a wall or the palm of his hand, the compressed air from the central and secondary orifice discharge openings will escape through the tertiary air passages by reversing the flow of air therethrough. The secondary and tertiary air passages thus simultaneously provide for meeting the OSHA sound limit and pressure limit standards. This is done in an uncomplicated and inexpensive structure having wide mechanical tolerances and being free of moving parts.

It is therefore an object of the present invention to provide an improved low noise air nozzle; an air nozzle in which a low pressure curtain of induced ambient air surrounds the discharge of compressed air; in which the flow of low pressure air is induced by a venturi effect from interior high pressure discharge openings; in which the low pressure air flow is induced from the ambient atmosphere through additional air passages surrounding the primary air passages; in which the additional air passages provide an alternate escape route for the compressed air if the nozzle outlet becomes obstructed; and to accomplish the above objects and purposes in an uncomplicated, inexpensive, durable and reliable configuration readily suited to easy mass production and wide industrial utilization.

Other objects and advantages of the invention will be apparent from the following description, the accompanying drawings and the appended claims.

DESCRIPTION OF THE PREFERRED EMBODIMENT

Figure 1:
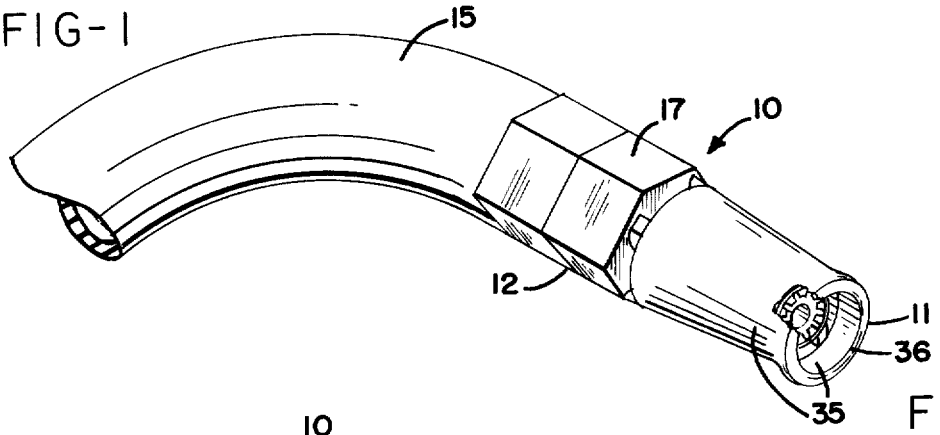
FIG. 1 is a perspective view of the low noise air nozzle attached to an air hose, with a portion of the shroud at the outlet broken away to show details of the discharge openings.

The nozzle 10 illustrated in FIG. 1 has an outlet end 11 and an inlet end 12. The inlet end 12 has an internally threaded hose fitting 14 for receiving a compressed air hose 15 for supplying compressed air to a central bore or manifold 16 within the middle of the body 17 of the nozzle 10. A central or primary orifice 20 receives compressed air from the manifold 16 and passes longitudinally and axially through body 17 to a discharge opening 21 which discharges a stream 23 of compressed air at the outlet end 11 of the nozzle 10.

Figure 2:
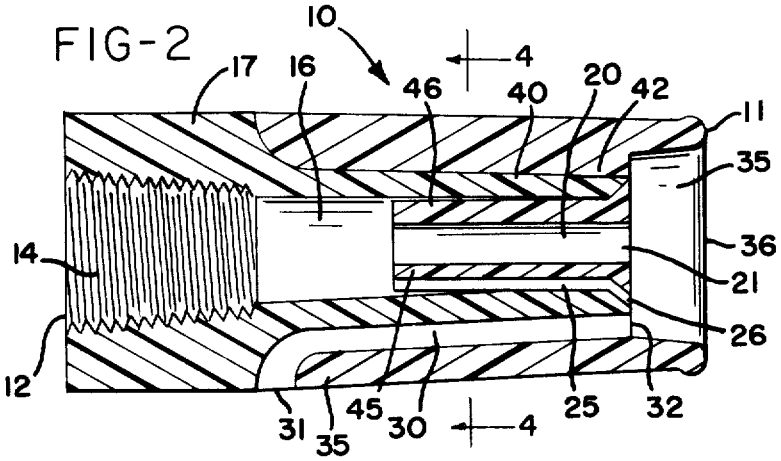
FIG. 2 is a cross sectional view of the nozzle taken on line 2—2 of FIG. 3.
Figure 3:
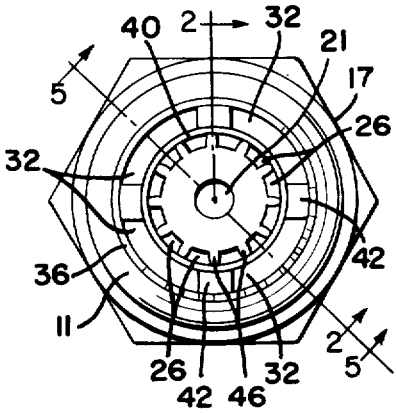
FIG. 3 is a view of the outlet end of the nozzle.
Figure 4:
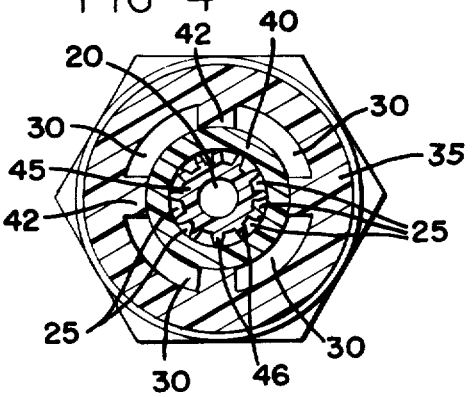
FIG. 4 is a cross sectional view taken on lines 4—4 of FIG. 2 and FIG. 6.
Figure 5:
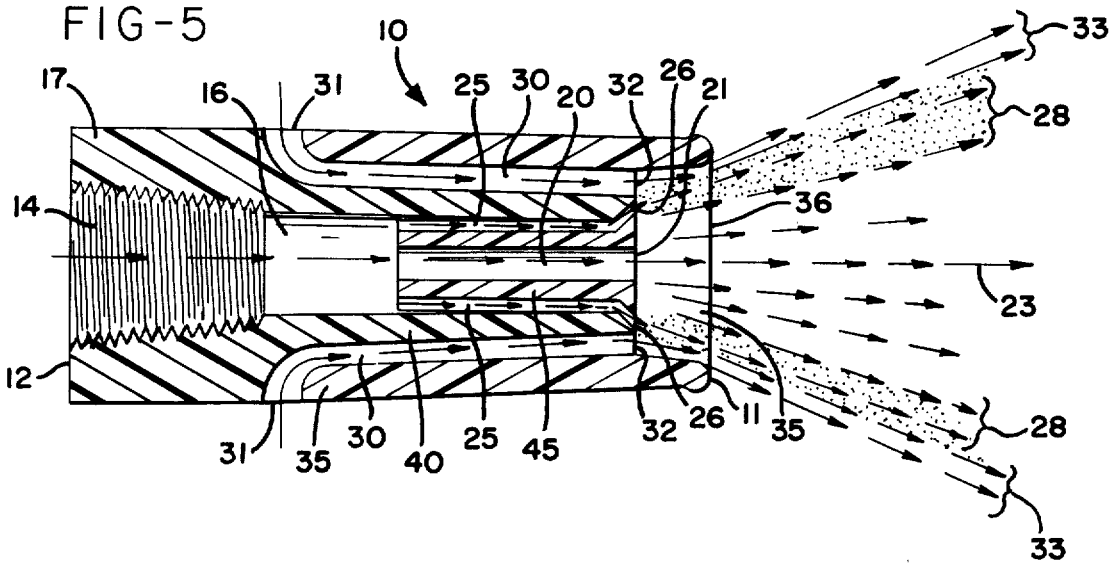
FIG. 5 is across sectional view taken on line 5—5 of FIG. 3.
Figure 6:
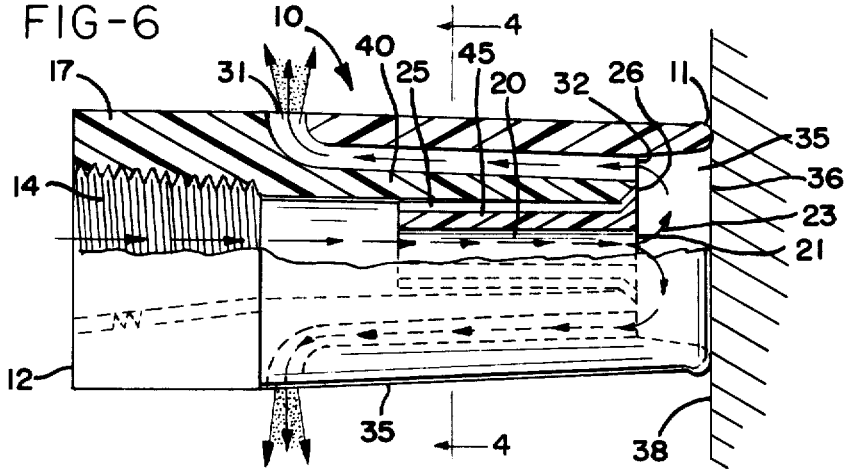
FIG. 6 is a partially broken away view similar to FIG. 5 illustrating release of the compressed air when the nozzle outlet is obstructed.

A series of secondary orifices 25 extend from the manifold 16 longitudinally and parallel to the central orifice 20. The secondary orifices 25 also receive compressed air from manifold 16 and carry it to a series of discharge openings 26 which completely surround the discharge opening 21 of the central orifice 20. As illustrated in FIGS. 2, 5, and 6, the secondary orifice discharge openings 26 are angled outwardly so that the discharge of compressed air therefrom defines an expanding or diverging annular cone of air 28 (FIG. 5) surrounding the stream of air 23 coming from the central orifice discharge opening 21. Although a plurality of secondary orifices 25 is shown, a greater or lesser number than illustrated could also be used. In fact, it is believed that under the proper circumstances even a single ring-shaped secondary orifice would work.

A plurality of tertiary air passages 30 surrounds the central and secondary orifices 20 and 25. Tertiary air passages 30 have radially directed inlets 31 which are located on the outside of the nozzle body 17 near the hose fitting 14. The tertiary air passages also have outlets 32 adjacent to and surrounding the secondary orifice discharge openings 26 at the outlet end 11 of the nozzle 10.

The exterior of the discharge half of the nozzle 10 is defined by a shroud 35 which extends for a small distance beyond the discharge openings 21 and 26 and the tertiary air passage outlet 32, the end of the shroud thereadjacent defining the shroud outlet 36.

Thus, as compressed air is supplied by the compressed air hose 15 through the manifold 16, the compressed air is discharged through openings 21 and 26. As the cone of air 28 from discharge openings 26 flows past the tertiary air passage outlet 32, a venturi effect is created resulting in reduced pressure at the tertiary air passage outlets 32. This induces a flow of ambient air into and through the tertiary air passages 30. The flow of low pressure air then forms a shroud of ambient air 33 which surrounds the cone of air 28 as it and the stream of air 23 from discharge opening 21 leave the nozzle 10.

FIG. 6 illustrates what occurs if the discharge or outlet end 11 of the nozzle 10 becomes obstructed. As illustrated, the outlet end 11 of the nozzle has been placed against a wall 38, causing the flow through the tertiary air passages to reverse as compressed air escapes through the tertiary air passages. Thus undue pressure is not developed at the nozzle outlet end when the nozzle becomes obstructed. Further, the radially directed inlets 31 now direct the escaping compressed air outwardly in a generally radial direction. This discourages debris from blowing backwardly against the operator by providing a curtain of sideways moving air to deflect such debris. Debris which backfires through the tertiary air passages 30 at such times will likewise be deflected sideways.

The preferred embodiment illustrated in the drawings is actually made of only three uncomplicated, easily molded, and easily assembled parts. As illustrated, the main body portion 17 has a tubular core 40 extending over more than half of its length toward the nozzle outlet end 11. The shroud 35 is press fitted onto the exterior of the core 40, and is supported thereon by stand-off bosses 42 formed as part of, and located on, the interior of the shroud 35. The spaces thus formed between the bosses 42, the outside of the core 40, and the inside of the shroud 35 are the tertiary air passages 30.

Similarly, a hollow plug 45 having exterior splines 46 is press fitted into the hollow interior of core 40 at outlet end 11, the splines 46 firmly gripping the interior surface of core 40. The hollow interior of plug 45 defines the central orifice 20, and the spaces between the splines 46 and the interior of the tubular core 40 define the secondary orifices 25. As illustrated, and as explained earlier, the end of the interior of core 40 and the corresponding end of plug 45 are bevelled or angled outwardly with respect to the central orifice 20.

As may be seen, therefore, the present invention provides numerous advantages. It is uncomplicated in construction, has no moving parts, and may be easily and inexpensively fabricated. It provides a substantial reduction in operating noise levels, as well as automatic pressure relief in the event that the outlet end of the nozzle becomes obstructed. Both benefits are provided in part by the tertiary air passages which, during normal operation, permit a flow of ambient air to be induced through the nozzle to form a low pressure curtain around the discharged compressed air, effectively reducing the noise level of the nozzle. Upon obstruction of the nozzle outlet, the flow through the tertiary air passages is reversed, allowing the compressed air to escape. The noise reduction is thus accomplished without expensive, complicated acoustical structures or baffles, and the pressure relief does not involve valves or other moving parts.

While the form of apparatus herein described constitutes a preferred embodiment of this invention, it is to be understood that the invention is not limited to this precise form of apparatus, and that changes may be made therein without departing from the scope of the invention.

What is claimed is:

1. An air nozzle comprising:

a. a body, b. means on said body for receiving a supply of compressed air, c. means forming a central orifice having a discharge opening through said body on one side thereof and connecting to said compressed air receiving means for discharging a stream of compressed air through said central orifice opening, d. means forming at least one secondary orifice having a discharge opening through said one side of said body adjacent to and surrounding said central orifice opening, said secondary orifice also connecting to said compressed air receiving means, and said secondary orifice opening being shaped to discharge compressed air therefrom in an outwardly expanding or diverging annular cone surrounding the stream of air from said central orifice, e. means forming at least one tertiary air passage through said body, said tertiary air passage having an outlet through said one side of said body adjacent to and surrounding said secondary orifice discharge opening, and an inlet on the exterior of said body on another portion thereof removed from said central, secondary, and tertiary discharge and outlet openings, and f. a shroud surrounding said central, secondary, and tertiary discharge and outlet openings and extending a predetermined distance outwardly therefrom to define a shroud outlet, said secondary discharge opening inducing a forward flow of low pressure air through said tertiary air passage from its inlet to its outlet as compressed air is discharged through said primary and secondary discharge openings, said flow of low pressure air accompanying and surrounding said compressed air discharges when said shroud outlet is not blocked, and said compressed air escaping from said nozzle by causing a reverse air flow through said tertiary air passage when said shroud outlet is blocked.

2. The air nozzle of claim 1 further comprising a plurality of said secondary orifices.

3. The air nozzle of claim 2 wherein said central orifice extends longitudinally through said nozzle body, said secondary orifices extend parallel to said central orifice, and said secondary orifices are angled outwardly from said central orifice at said secondary orifice discharge openings to discharge the compressed air therefrom in said outwardly expanding or diverging annular cone.

4. The air nozzle of claim 1 further comprising a plurality of said tertiary air passages.

5. The air nozzle of claim 4 wherein said tertiary air passage inlet openings are located on the side of said air nozzle near the end thereof opposite said primary, secondary, and tertiary discharge and outlet openings.

6. An air nozzle comprising:

a. a tubular body portion having inlet and outlet ends on opposite ends of said body, b. means on the inlet end of said body portion for receiving a supply of compressed air, c. a tubular core forming a part of said body portion and extending over at least half the length of said body portion toward said outlet end, d. a hollow plug having exterior splines and being press fitted into said tubular core at the end thereof on the outlet end of said body portion, e. the hollow interior of said plug forming a central orifice extending longitudinally through at least part of said tubular body portion and having a discharge opening through said outlet end of said body portion, said central orifice connecting through said plug and said tubular core to said compressed air receiving means for receiving compressed air therefrom and discharging a stream of compressed air through said central orifice discharge opening, f. said splines and the inner surface of said tubular core forming a plurality of secondary orifices extending parallel to and surrounding said central orifice and having discharge openings through said outlet end of said body portion adjacent to and surrounding said central orifice discharge opening, said secondary orifices also connecting to said compressed air receiving means for receiving compressed air therefrom, and said splines and tubular core inner surface being angled outwardly at said outlet end of said body portion to angle said secondary orifice discharge openings outwardly from said central orifice discharge opening to discharge the compressed air from said secondary orifice discharge openings in an outwardly expanding or diverging annular cone surrounding the stream of compressed air from said central orifice discharge opening, and g. a shroud having stand-off bosses on the interior thereof press fitted onto the exterior of said tubular core to form a plurality of tertiary air passages between said shroud and the outside of said tubular portion, said tertiary air passages including generally radially directed inlet openings located on the side of said air nozzle near said compressed air receiving means and outlets through said outlet end of said air nozzle adjacent to and surrounding said secondary orifice discharge openings, said shroud surrounding said central, secondary, and tertiary discharge and outlet openings and extending a predetermined distance outwardly therefrom to define a shroud outlet, said secondary discharge openings inducing a forward flow or low pressure air through said tertiary air passages from their inlets to their outlets as compressed air is discharged through said central and secondary discharge openings, said flow of low pressure air accompanying and surrounding said compressed air discharges when said shroud outlet is not blocked, and said compressed air escaping generally radially from said nozzle by causing a reverse air flow through said tertiary air passages when said shroud outlet is blocked.

* * * * *